US007462203B2

(12) United States Patent
Goldoni et al.

(10) Patent No.: US 7,462,203 B2
(45) Date of Patent: Dec. 9, 2008

(54) METHOD OF DISPOSING WASTE FROM IN-HOME DRY CLEANING MACHINE USING DISPOSABLE, CONTAINMENT SYSTEM

(75) Inventors: Francesca Goldoni, Vlaardingen (NL); Kees Van Kralingen, Vlaardingen (NL); Dennis Stephen Murphy, Wyckoff, NJ (US); Michael Orchowski, East Rutherford, NJ (US); Pieter E M Overdevest, Vlaardingen (NL)

(73) Assignee: Whirlpool Corporation, Benton Harbor, MI (US)

( * ) Notice: Subject to any disclaimer, the term of this patent is extended or adjusted under 35 U.S.C. 154(b) by 735 days.

(21) Appl. No.: 10/745,073

(22) Filed: Dec. 23, 2003

(65) Prior Publication Data

US 2005/0133462 A1 Jun. 23, 2005

(51) Int. Cl.
*D06L 1/00* (2006.01)

(52) U.S. Cl. ..... 8/141; 8/142

(58) Field of Classification Search ..... 8/141, 8/142

See application file for complete search history.

(56) References Cited

U.S. PATENT DOCUMENTS 4,252,546 A 2/1981 Krugmann et al.
4,879,888 A 11/1989 Suissa
5,107,606 A * 4/1992 Tsubaki et al. ..... 34/596
5,360,547 A 11/1994 Cockett et al.
5,431,827 A 7/1995 Tatch
5,460,018 A 10/1995 Werner et al.
5,488,842 A 2/1996 Nishioka et al.
5,511,264 A 4/1996 Nishioka et al.
5,865,851 A 2/1999 Sidoti et al.
6,045,588 A 4/2000 Estes et al.
6,258,130 B1 7/2001 Murphy
6,269,667 B1 8/2001 Back et al.
6,299,779 B1 10/2001 Pattee
6,309,425 B1 10/2001 Murphy
6,327,731 B2 12/2001 Back et al.
6,451,066 B2 9/2002 Estes et al.
6,475,968 B1 11/2002 Murphy et al.
6,591,638 B2 7/2003 Estes et al.
6,766,670 B2 7/2004 Estes et al.
6,811,811 B2 11/2004 Gerald France et al.
6,846,790 B2 1/2005 Evers et al.
6,900,166 B2 5/2005 Evers et al.
2001/0054202 A1 * 12/2001 Severns et al. ..... 8/142
2002/0056163 A1 5/2002 Estes
2002/0133886 A1 * 9/2002 Severns et al. ..... 8/142
2003/0097718 A1 5/2003 Evers et al.
2003/0196277 A1 10/2003 Hallman et al.
2003/0204917 A1 11/2003 Estes et al.
2003/0226214 A1 * 12/2003 Radomyselski et al. ..... 8/137
2004/0088795 A1 5/2004 Orchowski et al.
2004/0088846 A1 5/2004 Murphy et al.
2004/0117919 A1 6/2004 Conrad et al.
2004/0129032 A1 7/2004 Severns et al.
2004/0139555 A1 7/2004 Conrad et al.
2004/0226106 A1 * 11/2004 Gardner et al. ..... 8/142

(Continued)

*Primary Examiner*—Lorna M. Douyon
*Assistant Examiner*—Amina Khan
(74) *Attorney, Agent, or Firm*—Clifton Green; Michael D. Lafrenz

(57) ABSTRACT

The present invention relates to a method of disposing waste from an in-home dry cleaning machine using a disposable containment system.

10 Claims, 2 Drawing Sheets

U.S. PATENT DOCUMENTS

2005/0034246 A1 2/2005 Reinhoudt et al.
2005/0037938 A1 2/2005 Reinhoudt et al.
2005/0043196 A1 2/2005 Wright et al.
2005/0071928 A1 4/2005 Wright et al.
2005/0091755 A1 5/2005 Conrad et al.
2005/0091756 A1 5/2005 Wright et al.
2005/0091757 A1 5/2005 Luckman et al.
2005/0092033 A1 5/2005 Luckman et al.
2005/0092352 A1 5/2005 Luckman et al.
2005/0096243 A1 5/2005 Luckman et al.
2005/0126606 A1 6/2005 Goedhart et al.
2005/0132502 A1 6/2005 Goldoni et al.
2005/0150059 A1 7/2005 Luckman et al.
2005/0155393 A1 7/2005 Wright et al.
2005/0222002 A1 10/2005 Luckman et al.
2005/0257812 A1 11/2005 Wright et al.
2005/0263173 A1 12/2005 Luckman et al.
2006/0260064 A1 11/2006 Luckman et al.
2006/0260065 A1 11/2006 Wright et al.

* cited by examiner

METHOD OF DISPOSING WASTE FROM IN-HOME DRY CLEANING MACHINE USING DISPOSABLE, CONTAINMENT SYSTEM

FIELD OF INVENTION

The present invention relates to in-home dry cleaning machines and processes and, in particular, to methods of disposing waste (oils, dirt, spent surfactants, etc.) generated during the dry cleaning process and which waste (waste both insoluble and soluble in solvent) has been separated from the dry cleaning solvent.

BACKGROUND

Dry cleaning processes for cleaning laundry articles are those in which an organic solvent, rather than water, is used as the primary medium for cleansing articles. In general, dry cleaning helps avoid damage which may be associated with aqueous washing (e.g., shrinkage or dye transfer).

The prior art discloses dry cleaning processes and machines which can be used by a consumer in his or her home (See, for example WO 01/94675, assigned to P&G). Typically dry cleaning machines use a dry cleaning solvent (e.g., typically a non-flammable, non-chlorine containing organic dry cleaning solvent or mixture of solvents).

The dry cleaning solvent composition is typically a composition comprising, in addition to solvent, small amounts of surfactant (as described, for example; in U.S. Pat. No. 6,623,530 to Murphy et al.) and the composition is contacted with a fabric article (any article that is customarily cleaned in a conventional laundry process or in a dry cleaning process; the term encompasses articles of clothing, linen, drapery and clothing accessories and also encompasses items made in whole or part of fabric such as tote bags, furniture covers, karpaulins and the like).

After the article is contacted with the dry cleaning solvent composition, typically there is generated a waste product which is the solvent in combination with lint and oils, spent surfactant etc. The solvent is then typically separated or "regenerated" from the waste product. In commercial dry cleaning machines, the waste which is accumulated in the machine is typically collected (e.g., by filtration distillation) in a compartment of the machine. In order to dispose of the waste, a service provider must empty the waste from the machine, risking exposure to the waste and/or solvent not fully separated from the waste. The waste must then be carted off by the provider.

In co-pending U.S. application Ser. No. 10/293,807 , now published as U.S. 2004/008846 to Murphy, there is disclosed a method for collecting and servicing the solvent which is separated from the waste, but this application is silent about what happens with the waste and certainly does not disclose a method of disposing waste collected in a detachable or removable container.

In WO. 03/022982 to Proctor and Gamble, waste (in form of laundry additive) is separated from solvent and part of the waste (e.g., as lint) is removed in laundry filters (see pg. 4 lines 10-13) while the remainder of separated waste product is deposited down a drain. The reference neither teaches nor suggests collecting separated waste fluid (e.g., anything other than solvent that passes through laundry filters) in a disposable collection area or container whereby the waste can be removed by the home user him or herself in a closed, detachable container without requiring service person to come and remove waste. Further, the subject invention avoids having to wash waste materials into municipal water treatment facilities as well as possibly clogging the consumer's drain.

BRIEF SUMMARY OF INVENTION

The present invention relates to a detachable/removable, disposable waste containment system for removing waste from an in-home dry cleaning machine. More particularly it relates to a method of eliminating waste from an in-home dry cleaning system which method comprises:

(1) passing, sending and/or pumping dry cleaning solvent comprising waste generated from said in-home dry cleaning machine to a containment area which is integrated with (i.e., part of) or adjacent to the machine; (the waste in the final container comes from debris generated in the machine drum and carried by the solvent; some of the waste/debris is insoluble in the solvent and some is soluble in the solvent; to the extent that insoluble waste may be removed by filtration (e.g., with a filter attached to the drum or further downstream) from the rest of the solvent (which still comprises soluble waste), or that the soluble waste still in the solvent can be captured (e.g., by evaporation or distillation), the waste in the containment area may comprise: a) both soluble and insoluble waste separated from the solvent; or b) only soluble waste collected from the solvent (insoluble waste having been separately filtered to a different collection area); in a preferred embodiment of the invention, the insoluble waste has been previously filtered out in a separate container, the soluble waste is then separated (e.g., by distillation or evaporation) and waste in the containment area is formed only from waste previously soluble in the solvent);

(2) optionally (as indicated above) separating waste which is insoluble in the solvent (while it is in route to or already in the containment area) from the rest of the solvent (preferred);

(3) separating waste which is soluble in the solvent (while it is in route to or already in the containment area) from the solvent;

(4) collecting waste (preferably soluble waste which has been separated from solvent, the insoluble waste having been previously filtered and the solvent itself being passed on for re-use) in a detachable/removable, disposable container which may be removed and detached by home user.

BRIEF DESCRIPTION OF DRAWINGS

FIG. 1, shows both an optional (and preferred) filtration area where insoluble waste may be separated from solvent (containing soluble waste); and "purification apparatus" where the solvent is now separated from soluble waste (e.g., by distillation or evaporation with waste from distillation and evaporation gravity fed to a removable container). In the most preferred embodiment, the container has only soluble waste previously carried in the solvent. It should be understood that all permutations of these filters and purification devices are possible and that any such devices can be located in any suitable place. In FIG. 1, the removable container is internal to the machine.

DETAILED DESCRIPTION OF INVENTION

Figure 1:
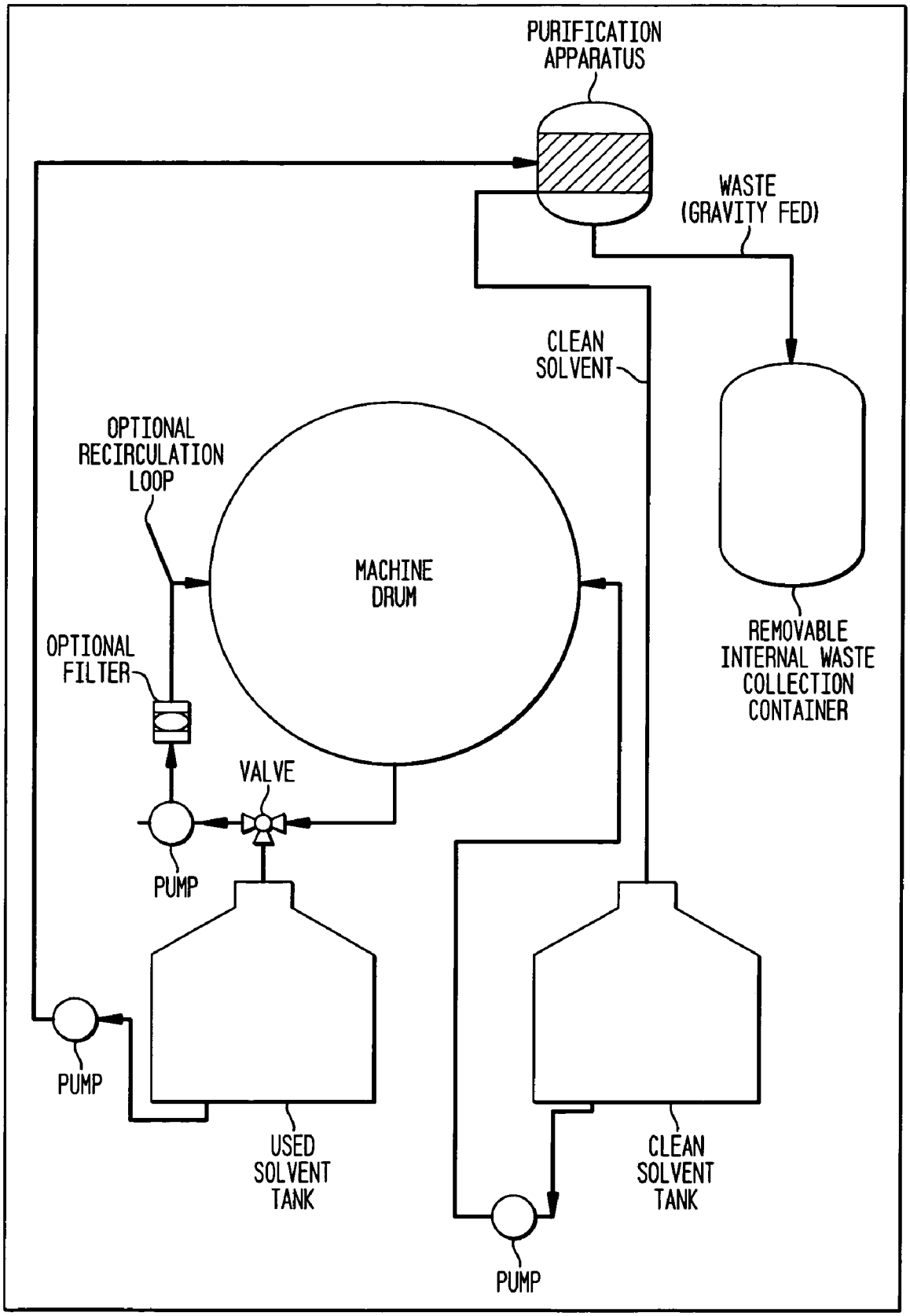
FIG. 1 is a schematic diagram of various components used in the in-home dry cleaning machine of the invention. Thus, for example, wash in the machine drum will generate spent or used solvent which contains both waste soluble in the solvent as well as dirt, debris, etc. not soluble in the solvent.
Figure 2:
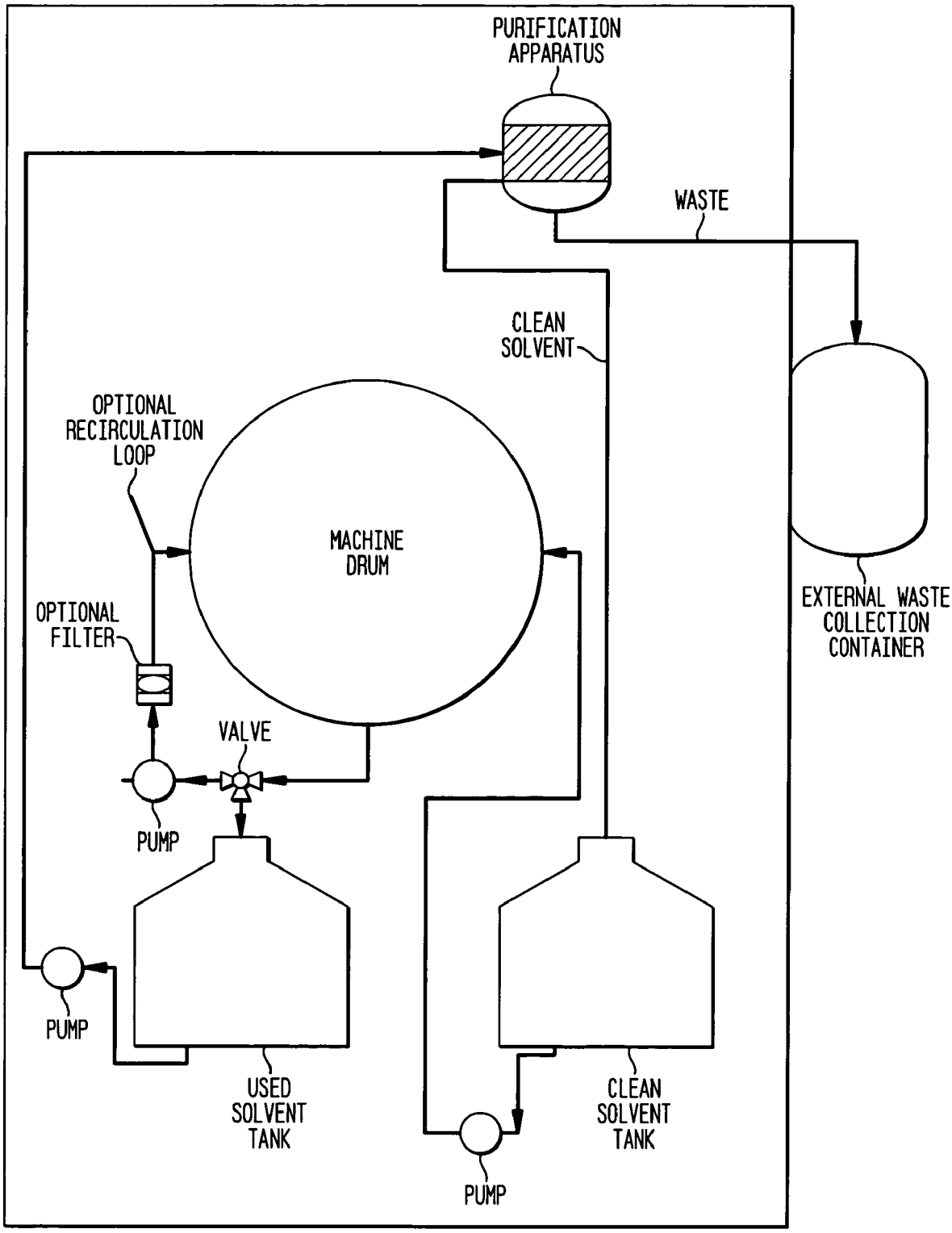
FIG. 2 is identical to FIG. 1 but shows waste container external to the machine.

The term "dry cleaning process" used herein is intended to mean any process wherein laundry articles are contacted with a dry cleaning composition within a closable vessel. However, as used herein this term does not include any process comprising steps wherein the laundry articles are also immersed and rinsed in an aqueous cleaning composition comprising more than 80 wt. % water because this would damage garments that can only be dry cleaned.

The term "dry cleaning composition" as used herein is intended to mean the composition used in the dry cleaning process including the dry cleaning solvent, any surfactant, cleaning agents but excluding the laundry articles that are to be cleaned.

The term "organic dry cleaning solvent" as used herein is intended to mean any non-aqueous solvent that preferably has a liquid phase at 20° C. and standard pressure. The term organic has its usual meaning, i.e., a compound with at least one carbon hydrogen bond.

The term "laundry article" or "fabric article" as used herein is typically a garment but may include any textile article. Textile articles include—but are not limited to—those made from natural fibers such as cotton, wool, linen, hemp, silk and man made fibers such as nylon, viscose, acetate, polyester, polyamide, polypropylene elastomer, natural or synthetic leather, natural or synthetic fur and mixtures thereof.

The term "waste" may refer to either the combination of oils, dirt, undesirable substances and lint (if not removed by an optional filter) with solvent, or combination of same without solvent. Generally, with solvent removed, the waste is more pasty or solid and less likely to leach from a container which might be buried, for example, in a landfill.

When considering the term waste as separate from solvent, waste may be insoluble in the solvent (and subject to filtration) or it may be soluble in the solvent (where it can be separated, for example, by distillation or evaporation).

The term "detachable/removable" means that the container can be readily accessed, released or removed by the user.

The present invention relates to a method of eliminating waste from in home dry cleaning machines. The waste product comprises the lint, soil, spent surfactant, etc. one would expect to be generated when solvent composition is contacted with fabric articles during a dry cleaning process except that, if an optional filter is used in the machine, the waste would not contain lint or other materials captured in the filter. In a preferred embodiment of the invention the soluble waste is filtered and only waste soluble in solvent is passed further on for separation from solvent before said soluble waste goes to (e.g., is gravity fed) a containment area.

Separating solvent from waste is desirable because the waste is collected and disposed of/buried at a future time, and a pastier, more solid waste is less likely to leach from the sealed container.

According to the process of the invention, a dry cleaning process is provided for in-home dry comprising a low and/or non-aqueous dry cleaning step of contacting a fabric article with a low and/or non-aqueous dry cleaning composition, wherein said composition comprises a non-flammable, non-chlorine containing organic dry cleaning solvent, water and surfactant.

One example of a composition which may be used with fabric articles is:

(a) 0.001 to 10 wt. % surfactant (b) 0 to 50 wt. % water (c) 0 to 50 wt. % of a cosolvent and a non-flammable, non-chlorine containing organic dry cleaning solvent.

The fabric may be treated in a low aqueous dry cleaning step, non-aqueous dry cleaning step, rinsing step etc.

The laundry articles in need of treatment are placed inside a closable vessel. It will be clear that the process is also suitable for cleaning one laundry article at the time although it will often be more efficient to clean more articles at the same time. Preferably, the vessel is a rotatable drum as part of an automated dry cleaning machine that is closed or sealed in such a way that the dry cleaning solvent can be contained within the machine if needed. Inside the vessel, the laundry articles are then contacted with the dry cleaning composition. This may be done in any way known in the art such as spraying or even using a mist.

In some cases it may be useful to formulate the dry cleaning composition in situ in the drum by contacting the different ingredients of the dry cleaning composition separately with the laundry articles. For example—when the dry cleaning composition comprises dry cleaning solvent, water and surfactant—first water, then surfactant followed by the dry cleaning solvent. Or first the dry cleaning solvent, followed by the surfactant and then water. Or any other order.

Alternatively, 2 or more of the ingredients may be premixed before they are contacted with the laundry articles. For example, water and surfactant may be premixed and this premix is then contacted with the laundry followed by the dry cleaning solvent. In the alternate, dry cleaning solvent and surfactant may be premixed and this premix is then contacted with the laundry followed by water.

Thus, in one aspect, in situ formulation of the dry cleaning composition may also be provided by incorporating one or more ingredients of the dry cleaning composition into a pretreatment composition, pretreating the laundry articles with the pretreatment composition, contacting the laundry articles with the remaining ingredients of the dry cleaning composition thereby formulating the dry cleaning composition in situ. This pretreatment may take place manually outside the drum or mechanically inside the drum as part of a pretreatment step. The pretreatment step per se need not be immersive, i.e., it may be limited to treating the stained areas only provided that when the laundry articles are contacted with all the ingredients making up the final dry cleaning composition, the laundry articles are immersed in said dry cleaning composition. For example—when the dry cleaning composition comprises of dry cleaning solvent, water and surfactant—stained areas of the laundry articles may be pre-treated with a premix of water and surfactant manually or by an automated process. After effective pretreatment time is allowed, the laundry articles may be contacted in the drum with the remaining ingredients such as in this case, the dry cleaning solvent (and optionally the remaining amounts of water and cleaning agent) to result in situ in the dry cleaning composition according to this aspect of the invention. The pretreatment time will be at least 5 sec but could be less than 1 day, preferably less than 1 hr, more preferably less than 30 min. The pretreatment composition may be formulated to treat specific stains. For example cleaning effective amounts of protease and other enzymes may be included to treat proteinacious stains.

In another embodiment, the complete dry cleaning composition is premixed in a separate premix compartment. For example, when the dry cleaning composition comprises dry cleaning solvent, surfactant and water, these may be premixed in a separate compartment before the dry cleaning composition is contacted with the laundry article. Preferably such a premix is in the form of an emulsion or microemulsion.

Forming a premix of for example a water-in-oil emulsion can be brought about by any number of suitable procedures. For example, the aqueous phase containing a cleaning effective amount of surfactant package can be contacted with the solvent phase by metered injection just prior to a suitable mixing device. Metering is preferably maintained such that the desired solvent/water ratio remains relatively constant. Mixing devices such as pump assemblies or in-line static mixers, a centrifugal pump or other type of pump, a colloid mill or other type of mill, a rotary mixer, an ultrasonic mixer and other means of dispersing one liquid in another, non-miscible liquid can be used to provide effective agitation to cause emulsification.

These static mixers are devices through which the emulsion is passed at high speed and in which said emulsion experiences sudden changes in direction and/or in the diameter of the channels which make up the interior of the mixers. This results in a pressure loss, which is a factor in obtaining a correct emulsion in terms of droplet size and stability.

In one variant of the method of the invention, the mixing steps are for example sequential. The procedure consists in mixing the solvent and emulsifier in a first stage, the premix being mixed and emulsified with the water in a second stage.

In another variant of the method of the invention, provision is made for carrying out the above steps in a continuous mode.

The premix may take place at room temperature, which is also the temperature of the fluids and raw materials used.

A batch process such as an overhead mixer or a continuous process such as a two fluid co-extrusion nozzle, an in-line injector, an in-line mixer or an in-line screen can be used to make the emulsion. The size of the emulsion composition in the final composition can be manipulated by changing the mixing speed, mixing time, the mixing device and the viscosity of the aqueous solution. In general, by reducing the mixing speed, decreasing the mixing time, lowering the viscosity of the aqueous solution or using a mixing device that produces less shear force during mixing, one can produce an emulsion of a larger droplet size. Especially preferred are ultrasonic mixers. Although the description above refers to the addition of surfactant it is understood it may also apply to the addition of cleaning agents.

While the laundry articles are in contact with the dry cleaning solvent, it is preferred to add mechanical energy for example by agitating or tumbling the laundry articles by rotating the drum or other means known in the art. Usually after one step, the dry cleaning solvent including any cleaning agents and/or loosened soil will be separated from the laundry articles. This is preferably done by spinning the laundry articles and collecting the dry cleaning composition, although other separation methods known in the art may also be employed such as evaporation. The dry cleaning solvent is then preferably recycled by separating the soil and/or cleaning agents from the solvent.

In other instances it may be advantageous to recirculate at least part of the dry cleaning composition during one step. For example, as shown in FIG. 1, by separating a portion of the dry cleaning composition from the laundry articles, passing the separated dry cleaning composition through a single valve and a single pump, optionally filtering soil from the separated portion of dry cleaning composition with an optional filter and contacting the laundry articles with the filtered portion of the dry cleaning composition, without directing the dry cleaning composition into a used solvent tank.

The surfactants, dry cleaning solvents, cosolvents and optional cleaning agents used in present invention are described below and may be the same or different for each step of the inventive process.

The dry cleaning is usually performed at atmospheric pressure and room temperature, between 10 and 30° C. in most countries. In some instances the process temperature may be elevated to just under the boiling point of the most volatile dry cleaning solvent used. Sometimes the process may be performed under reduced or elevated pressure, typically achieved via a vacuum pump or by supplying a gas, such as nitrogen, to the apparatus thereby increasing the pressure the closable vessel. The dry cleaning process may be carried out in any suitable apparatus. Preferably, the apparatus will comprise a closable vessel and means to recycle the dry cleaning solvents used to minimise solvent losses into the environment. The dry cleaning composition may be in the form of a micro-emulsion but usually will be in the form of a macro-emulsion, which is generally accepted to be thermodynamically unstable. A suitable process and appliance for dry cleaning is described in U.S. Pat. No. 6,045,588. The solvent will preferably be filtered and recycled in the same appliance. Generally, the laundry articles will be agitated in the dry cleaning process by tumbling, rotating, ultrasonics or any suitable type of mechanical energy (see U.S. Pat. No. 6,045,588).

Still other advantages and novel features of the present invention will become apparent to those skilled in the art from the following detailed description, which presents, by way of illustration, various exemplary modes contemplated for carrying out the invention. As will be realised, the invention is capable of other different aspects and objects all without departing from the invention. Accordingly, advantages, aspects, and descriptions are illustrative in nature and not restrictive.

Dry Cleaning Solvent

The dry cleaning solvent is usually a non-flammable, non-chlorine containing organic dry cleaning solvent. Although the term dry cleaning solvent is used in the singular, it should be noted that a mixture of solvents may also be used. Thus, the singular should be taken to encompass the plural, and vice versa. Because of the typical environmental problems associated with chlorine containing solvents, the solvent preferably does not contain Cl atoms. In addition, the solvent should not be flammable such as most petroleum or mineral spirits having typical flash points as low as 20° C. or even lower. The term non-flammable is intended to describe dry cleaning solvents with a flash point of at least 37.8° C., more preferably at least 45° C., most preferably at least 50° C. The limit of a flashpoint of at least 37.8° C. for non-flammable liquids is defined in NFPA 30, the Flammable and Combustible Liquids Code as issued by National Fire Protection Association, 1996 edition, Massachusetts USA. Preferred test methods for determining the flash point of solvents are the standard tests as described in NFPA 30. One preferable class of solvents is a fluorinated organic dry cleaning solvent including hydrofluorocarbon (HFC) and hydrofluoroether (HFE). However even more preferred are non flammable non-halogenated solvents. For example other classes of suitable highly preferred solvents are siloxanes and hydrocarbons (see below). It should be noted that mixtures of different dry cleaning solvents may also be used.

The most desirable solvents are non-ozone depleting and a useful common definition for the ozone depleting potential is defined by the Environmental Protection Agency in the USA: the ozone depleting potential is the ratio of the impact on ozone of a chemical compared to the impact of a similar mass of CFC-11. Thus, the ODP of CFC-11 is defined to be 1.0.

Hydrofluorocarbons

One preferred hydrofluorocarbon solvent is represented by the formula $C_xH_yF_{(2x+2-y)}$, wherein x is from 3 to 8, y is from 1 to 6, the mole ratio of F/H in the hydrofluorocarbon solvent is greater than 1.6.

Preferably, x is from 4 to 6 and most preferred x is 5 and y is 2.

Especially suitable are hydrofluorocarbon solvents selected from isomers of decafluoropentane and mixtures thereof. In particular useful is 1,1,1,2,2,3,4,5,5,5-decafluoropentane. The E.I. Du Pont De Nemours and Company markets this compound under the name Vertrel XF™.

Hydrofluoroethers

Hydrofluoroethers (HFEs) suitable for use in the present invention are generally low polarity chemical compounds minimally containing carbon, fluorine, hydrogen, and catenary (that is, in-chain) oxygen atoms. HFEs can optionally contain additional catenary heteroatoms, such as nitrogen and sulphur. HFEs have molecular structures which can be linear, branched, or cyclic, or a combination thereof (such as alkylcycloaliphatic), and are preferably free of ethylenic unsaturation, having a total of about 4 to about 20 carbon atoms. Such HFEs are known and are readily available, either as essentially pure compounds or as mixtures.

Preferred hydrofluoroethers can have a boiling point in the range from about 40° C. to about 275° C., preferably from about 50° C. to about 200° C., even more preferably from about 50° C. to about 121° C. It is very desirable that the hydrofluoroether has no flashpoint. In general, when a HFE has a flash point, decreasing the F/H ratio or decreasing the number of carbon—carbon bonds each decreases the flash point of the HFE (see WO/00 26206).

Useful hydrofluoroethers include two varieties: segregated hydrofluoroethers and omega-hydrofluoroalkylethers. Structurally, the segregated hydrofluoroethers comprise at least one mono-, di-, or trialkoxy-substituted perfluoroalkane, perfluorocycloalkane, perfluorocycloalkyl-containing perfluoroalkane, or perfluorocycloalkylene-containing perfluoroalkane compound.

HFEs suitable for use in the processes of the invention include the following compounds:

$C_4F_9OC_2F_4H$ $HC_3F_6OC_3F_6H$ $HC_3F_6OCH_3$ $C_5F_{11}OC_2F_4H$ $C_6F_{13}OCF_2H$ $C_6F_{13}OC_2F_4OC_2F_4H$ c-$C_6F_{11}CF_2OCF_2H$ $C_3F_7OCH_2F$ $HCF_2O(C_2F_4O)_n(CF_2O)_mCF_2H$, wherein m=0 to 2 and n=0 to 3

$C_3F_7O[C(CF_3)_2CF_2O]_pCFHCF_3$, wherein p=0 to 5

$C_4F_9OCF_2C(CF_3)_2CF_2H$ $HCF_2CF_2OCF_2C(CF_3)_2CF_2OC_2F_4H$ $C_7F_{15}OCFHCF_3$ $C_8F_{17}OCF_2O(CF_2)_5H$ $C_8F_{17}OC_2F_4OC_2F_4OC_2F_4OCF_2H$ $C_4F_9OC_2H_5$ $C_4F_9OCH_3$ $C_8F_{17}OCH_3$

Preferred HFEs are according to the formula $$C_nX_{2n+1}—O—C_mY_{2m+1}$$

wherein X and Y are each independently F or H provided that at least one F is present. Preferably, X=F and Y=H; n=2-15 and m=1-10, but preferably, n=3-8 and m=1-4, or more preferably n=4-6 and m=1-3.

Especially preferred is a HFE wherein n=4 and m=1 or 2 which is marketed under the name of HFE 7100™ and 7200™ respectively by the 3M corporation.

Mixtures of different organic dry cleaning solvents may also be used. For example, a suitable dry cleaning composition may comprise a mixture of HFEs together with a mixture of hydrocarbons and/or siloxanes When solvent compounds are mentioned, isomers thereof are also included. Thus, suitable HFEs include nonafluoromethoxybutane (C4F9OCH3) isomers such as 1,1,1,2,2,3,3,4,4-nonafluoro-4-methoxy-butane (CH3OCF2CF2CF2CF3), 1,1,1,2,3,3-hexafluoro-2-(trifluoromethyl)-3-methoxy-propane (CH3OCF2CF(CF3)2), 1,1,1,3,3,3-hexafluoro-2-methoxy-2-(trifluoromethyl)-propane (CH3OC(CF3)3), and 1,1,1,2,3,3,4,4,4-nonafluoro-2-methoxy-butane (CH3OCF(CF3)CF2CF3), approximate isomer boiling point=60° C.; Also isomers of nonafluoroethoxybutane (C4F9OC2H5) such as 1,1,1,2,2,3,3,4,4-nonafluoro-4-ethoxybutane (CH3CH2OCF2CF2CF2CF3), 1,1,1,2,3,3-hexafluoro-2-(trifluoromethyl)-3-ethoxypropane (CH3CH2OCF2CF(CF3)2), 1,1,1,3,3,3-hexafluoro-2-ethoxy-2-(trifluoromethyl)-propane (CH3CH2OC(CF3)3), and 1,1,1,2,3,3,4,4,4-nonafluoro-2-ethoxybutane (CH3CH2OCF(CF3)CF2CF3) with approximate isomer boiling points of 73° C.

Siloxane Dry Cleaning Solvent

Some siloxane solvents may also be used advantageously in the present invention. The siloxane may be linear, branched, cyclic, or a combination thereof. One preferred branched siloxane is tris (trimethylsiloxyl) silane. Also preferred are linear and cyclic oligo dimethylsiloxanes are preferred. One preferred class of siloxane solvents is an alkylsiloxane represented by the formula:

$$R_3—Si(—O—SiR_2)_w—R$$

where each R is independently chosen from an alkyl group having form 1 to 10 carbon atoms and w is an integer from 1 to 30. Preferably, R is methyl and w is 1-4 or even more preferably w is 3 or 4.

Of the cyclic siloxane octamethyl cyclotetrasiloxane and decamethyl cyclopentasiloxane are particularly effective.

Very useful siloxanes are selected from the group consisting of decamethyl tetrasiloxane, dodecamethyl pentasiloxane and mixtures thereof.

Hydrocarbon Dry Cleaning Solvent

Hydrocarbon dry cleaning solvents that can be used in the present invention are non-flammable as defined above and include isoparaffinic solvents. As used herein, the term "isoparaffinic solvent" means one or more branched alkanes having on average, at least 9 carbon atoms, preferably from 10 to 16 carbon atoms.

Suitable isoparaffinic solvents, include those sold as DF-2000 or Isopar L, namely a mixture of $C_{11}$ to $C_{15}$ alkanes ex Exxon Mobil. These isoparaffinic solvents are branched chain fully saturated hydrocarbons and are characterised by boiling range. These mixtures are available in boiling ranges from 180° C. to 210° C. In addition to the isoparaffinic hydrocarbons, non-flammable hydrocarbon solvents including low petroleum odour solvents having a boiling range of 195° C. to 250° C. and d-Limonene may also be useful. From an odour standpoint, the isoparaffinic solvents are preferred, as these materials have a low odour. However, if odour is not a consideration, substantially any of the above solvents can be utilised. Preferably, the organic solvent is not a terpene.

Especially suitable organic dry cleaning solvents include those selected from the group consisting of the isomers of nonafluoromethoxybutane, nonafluoroethoxybutane and decafluoropentane, octamethyl cyclotetrasiloxane, decamethyl cyclopentasiloxane, decamethyl tetrasiloxane, dodecamethyl pentasiloxane, isoparaffinic solvents and mixtures thereof. Even more preferred are organic dry cleaning solvents include those selected from the group consisting of octamethyl cyclotetrasiloxane, decamethyl cyclopentasiloxane, decamethyl tetrasiloxane, dodecamethyl pentasiloxane, isoparaffinic solvents and mixtures thereof.

The dry cleaning compositions of the invention generally contain greater than about 50 percent by weight of organic dry cleaning solvent, preferably greater than about 75 weight percent, more preferably greater than about 80 weight percent, more preferably greater than about 85 weight percent, even more preferably greater than about 95 weight percent, but preferably less than 100 weight percent of organic dry cleaning solvent by weight of the total dry cleaning composition. Such amounts aid in improved drying times and maintain a high flashpoint or no flashpoint at all. For the rinse step or conditioning step the dry cleaning compositions may even comprise of at least 99 weight percent of organic dry cleaning solvent by weight of the total dry cleaning composition and sometimes even 100 weight percent of organic dry cleaning solvent.

Water

In some cases water may be used in the dry cleaning process and the amount of water is important. In those cases, the amount of water present in any step of the dry cleaning process is at such a level that laundry articles can be safely cleaned. This includes laundry articles that can only be dry cleaned. The amount of water present in the low aqueous dry cleaning composition is preferably from 0.01 to 50 wt. % water more preferably from 0.01 to 10 wt. %, even more preferably from 0.01 to 0.9 wt. % water by weight of the dry cleaning composition or more preferably, 0.05 to 0.8 wt. % or most preferable 0.1 to 0.7 wt. %. The amount of water present in the non-aqueous dry cleaning composition is preferably from 0 to 0.1 wt. % water by weight of the dry cleaning composition or more preferably, 0 to 0.01 wt. % or even more preferable 0 to 0.001 wt. % and most preferable 0 wt. %.

Cosolvents

The compositions of the invention may contain one or more cosolvents. The purpose of a cosolvent in the dry cleaning compositions of the invention is often to increase the solvency of the dry cleaning composition for a variety of soils. The cosolvent also enables the formation of a homogeneous solution containing a cosolvent, a dry cleaning solvent, and the soil; or a cosolvent, a dry cleaning solvent and an optional cleaning agent. As used herein, a "homogeneous composition" is a single phased composition or a composition that appears to have only a single phase, for example, a macro-emulsion, a micro-emulsion or an azeotrope. However, if a cosolvent is used the dry cleaning composition is preferably a non-azeotrope as azeotropes may be less robust.

Useful cosolvents of the invention are soluble in the dry cleaning solvent or water, are compatible with typical cleaning agents, and can enhance the solubilization of hydrophilic composite stains and oils typically found in stains on clothing, such as vegetable, mineral, or animal oils. Any cosolvent or mixtures of cosolvents meeting the above criteria may be used.

Useful cosolvents include alcohols, ethers, glycol ethers, alkanes, alkenes, linear and cyclic amides, perfluorinated tertiary amines, perfluoroethers, cycloalkanes, esters, ketones, aromatics, the fully or partly halogenated derivatives thereof and mixtures thereof. Preferably, the cosolvent is selected from the group consisting of alcohols, alkanes, alkenes, cycloalkanes, ethers, esters, cyclic amides, aromatics, ketones, the fully or partly halogenated derivatives thereof and mixtures thereof.

Representative examples of cosolvents which can be used in the dry cleaning compositions of the invention include methanol, ethanol, isopropanol, t-butyl alcohol, trifluoroethanol, pentafluoropropanol, hexafluoro-2-propanol, methyl t-butyl ether, methyl t-amyl ether, propylene glycol n-propyl ether, propylene glycol n-butyl ether, dipropylene glycol n-butyl ether, propylene glycol methyl ether, ethylene glycol monobutyl ether, trans-1,2-dichloroethylene, decalin, methyl decanoate, t-butyl acetate, ethyl acetate, glycol methyl ether acetate, ethyl lactate, diethyl phthalate, 2-butanone, N-alkyl pyrrolidone (such as N-methyl pyrrolidone, N-ethyl pyrrolidone), methyl isobutyl ketone, naphthalene, toluene, trifluorotoluene, perfluorohexane, perfluoroheptane, perfluorooctane, perfluorotributylamine, perfluoro-2-butyl oxacyclopentane.

Preferably, the cosolvent is present in the compositions of the invention in an effective amount by weight to form a homogeneous composition with the other dry cleaning solvent(s) such as HFE. The effective amount of cosolvent will vary depending upon which cosolvent or cosolvent blends are used and the other dry cleaning solvent(s) used in the composition. However, the preferred maximum amount of any particular cosolvent present in a dry cleaning composition should be low enough to keep the dry cleaning composition non-flammable as defined above.

In general, cosolvent may be present in the compositions of the invention in an amount of from about 1 to 50 percent by weight, preferably from about 5 to about 40 percent by weight, and more preferably from about 10 to about 25 percent by weight. In some exceptional cases the cosolvent may be present amounts of from about 0.01 percent by weight of the total dry cleaning composition.

Surfactants

The dry cleaning compositions of the invention can utilise many types of cyclic, linear or branched surfactants known in the art, both fluorinated and non-fluorinated. Preferred solvent compatible surfactants include nonionic, anionic, cationic and zwitterionic surfactants having at least 4 carbon atoms, but preferably less than 200 carbon atoms or more preferably less than 90 carbon atoms as described below. Solvent compatible surfactants usually have a solvent-philic part that increases the solubility of the surfactant in the dry cleaning solvent/composition. Effective surfactants may comprise of one or more polar hydrophilic groups and one or more dry cleaning solvent-philic parts having at least 4 carbon atoms so that the surfactant is soluble in said dry cleaning solvent/composition. It is preferred that the surfactant is soluble in the dry cleaning composition, i.e., to at least the amount of surfactant used in the dry cleaning composition at 20° C. The composition may comprise one or a mixture of surfactants depending on the desired cleaning and garment care. One preferred surfactant is an anionic surfactant. Another preferred surfactant is a cationic surfactant.

The polar hydrophilic group, Z, can be nonionic, ionic (that is, anionic, cationic, or amphoteric), or a combination thereof. Typical nonionic moieties include polyoxyethylene and polyoxypropylene moieties. Typical anionic moieties include carboxylate, sulfonate, sulfate, or phosphate moieties. Typical cationic moieties include quaternary ammonium, protonated ammonium, imidazolines, amines, diamines, sulfonium, and phosphonium moieties. Typical amphoteric moieties include betaine, sulfobetaine, aminocarboxyl, amine oxide, and various other combinations of anionic and cationic moieties.

Especially suitable surfactants comprise at least one polar hydrophilic group Z which is an anionic moiety whereby the counterion may be as described below.

The polar hydrophilic group Z is preferably selected from the group comprising —$SO_4M$, —$SO_3M$, —$PO_4M_2$, —$PO_3M_2$, —$CO_2M$ and mixtures thereof wherein each M can be independently selected from the group including H, $NR_4$, Na, K and Li, wherein each R is independently selected from H and $C_{1-4}$ alkyl radical but preferably H. Preferably M is H but in some cases salts may also be used.

Fluorinated Surfactants

In one preferred embodiment, the surfactant is fluorinated or more preferably a fluorinated acid.

Suitable fluorosurfactants are in most cases those according to the formula (I):

$$(Xf)_n(Y)_m(Z)_p \quad (I)$$

and contain one, two or more fluorinated radicals (Xf) and one or more polar hydrophilic groups (Z), which radicals and polar hydrophilic groups are usually (but not necessarily) connected together by one or more suitable linking groups (Y). Preferably, n and p are integers independently selected from 1 to 4 and m is selected from 0 to 4. When the surfactant comprises more than one Xf, Y or Z group, then each of Xf, Y and Z may be the same or different. Preferably, the polar hydrophilic group is connected by a covalent bond to Y, or in absence of Y, to Xf.

The fluorinated radical, Xf, can generally be a linear or cyclic, saturated or unsaturated, aromatic or non-aromatic, radical preferably having at least 3 carbon atoms. The carbon chain may be linear or branched and may include hetero atoms such as oxygen or sulphur, but preferably not nitrogen. Preferably, Xf is an aliphatic and saturated. A fully fluorinated Xf radical is preferred, but hydrogen or chlorine may be present as substituents provided that not more than one atom of either is present for every two carbon atoms, and, preferably, the radical contains at least a terminal perfluoromethyl group. Radicals containing no more than about 20 carbon atoms are preferred because larger radicals usually represent a less efficient utilisation of fluorine.

Especially suitable Xf groups can be based on perfluorinated carbon: $C_nF_{2n+1}$—wherein n is from 1-40, preferably 2 to 26, most preferably 2 to 18 or can be based on oligomers of hexafluoropropyleneoxide: $[CF(CF_3)—CF_2—O]_n$ wherein n is from 1 to 30. Suitable examples of the latter are marketed by E.I DuPont de Nemours and Co. under the name Krytox™ 157, especially, KrytoX™ 157 FSL. Fluoroaliphatic radicals containing about 2 to 14 carbon atoms are more preferred.

The linking group, Y, is selected from groups such as alkyl, alkylene, alkylene oxide, arylene, carbonyl, ester, amide, ether oxygen, secondary or tertiary amine, sulfonamidoalkylene, carboxamidoalkylene, alkylenesulfonamidoalkylene, alkyleneoxyalkylene, or alkylenethioalkylene or mixtures thereof. In one preferred embodiment Y is $(CH_2)_t$ or $(CH_2)_tO$ wherein t is 1 to 10, preferably 1 to 6, most preferably 2 to 4. Alternatively, Y may be absent, in which case Xf and Z are directly connected by a covalent bond.

A particularly useful class of fluoroaliphatic surfactants useful in this invention are those wherein Xf, Y, and Z are as defined, and n is 1 or 2, m is 0 to 2, and p is 1 or 2.

Examples of very useful surfactants are those comprising at least wherein n is 1 to 4, m is 0 to 4, and p is 1 to 4, Z is as defined and $$Xf=R^1$$

$$Y=(R^2)_v$$

wherein $R^1$ is a perfluoroalkyl group having 1 to 40 carbon atoms; $R^2$ is an alkyl or an alkylene oxide group having 2 to 6 carbon atoms; and v is 0-10

Preferably, the surfactant is according to the formula:

$$[R^1\text{-}R^2{}_v]_wPO(OH)_{3-w}$$

wherein $R^1$ is a perfluoroalkyl group having 1 to 26 carbon atoms; $R^2$ is an alkyl or an alkylene oxide group having 2 to 6 carbon atoms; v is 0-10 and w is 1-2.

More preferably, $R^1$ is a perfluoroalkyl group having 2 to 16 carbon atoms; $R^2$ is an alkyl or an alkylene oxide group having 2 to 6 carbon atoms; v is 1 and w is 1 or 2.

Most preferably, $R^1$ is a perfluoroalkyl group having 2 to 14 carbon atoms; $R^2$ is ethylene oxide; v=1 and w=1-2.

Non-Fluorinated Surfactant

One other suitable class of surfactants are non-fluorinated surfactants according the formula (II):

$$(Xh)_n(Y)_m(Z)_p \quad (II)$$

wherein Xh is a non-fluorinated radical and(Y), (Z),n, m and p are as described above for formula (I).

Xh may be a linear, branched or cyclic, saturated or unsaturated, aromatic or non-aromatic, radical preferably having at least 4 carbon atoms. Xh preferably includes hydrocarbon radicals. When Xh is a hydrocarbon, the carbon chain may be linear, branched or cyclic and may include hetero atoms such as oxygen, nitrogen or sulphur, although in some cases nitrogen is not preferred. Preferably, Xh is aliphatic and saturated. Radicals containing no more than about 24 carbon atoms are preferred. One preferred surfactant is an acid surfactant. Preferred surfactants include anionic surfactants. Anionic surfactants are generally known in the art and include, for example, alkyl aryl sulfonates (such as, for example, alkylbenzenesulfonates), alkyl aryl sulfonic acids (such as, for example, sodium and ammonium salts of toluene-, xylene- and isopropylbenzenesulfonic acids), sulfonated amines and sulfonated amides (such as, for example, amidosulfonates), carboxylated alcohols and carboxylated alkylphenol ethoxylates, diphenyl sulfonates, fatty esters, isethionates, lignin-based surfactants, olefin sulfonates (such as, for example, RCH═CHSO$_3$Na, where R is $C_{10}$-$C_{16}$), phosphorous-based surfactants, protein based surfactants, sarcosine-based surfactants (such as, for example, N-acylsarcosinates such as sodium N-lauroylsarcosinate), sulfates and sulfonates of oils and/or fatty acids, sulfates and sulfonates of ethoxylated alkylphenols, sulfates of alcohols, sulfates of ethoxylated alcohols, sulfates of fatty esters, sulfates of aromatic or fluoro containing compounds, sulfosuccinnamates, sulfosuccinates (such as, for example, diamyl-, dioctyl- and diisobutylsulfosuccinates), taurates, and sulfonic acids.

Examples of suitable non-fluorinated anionic surfactants include Crodafos™ 810A (ex Croda).

Other classes of suitable surfactants include, but are not limited to nonionic and cationic surfactants. Compounds suitable for use as the nonionic surfactant of the present invention are those that carry no discrete charge when dissolved in aqueous media. Nonionic surfactants are generally known in the art and include, for example, alkanol amides (such as, for example, coco, lauric, oleic and stearic monoethanolamides, diethanolamides and monoisopropanolamides), amine oxides (such as, for example, polyoxyethylene ethanolamides and polyoxyethylene propanolamides), polyalkylene oxide block copolymers (such as, for example, poly(oxyethylene-co-oxypropylene)), ethoxylated alcohols, (such as, for example, isostearyl polyoxyethylene alcohol, lauryl, cetyl, stearyl, oleyl, tridecyl, trimethyinonyl, isodecyl, tridecyl), ethoxylated alkylphenols (such as, for example, nonylphenol ), ethoxylated amines and ethoxylated amides, ethoxylated fatty acids, ethoxylated fatty esters and ethoxylated fatty oils (such as, for example, mono- and diesters of acids such as lauric, isostearic, pelargonic, oleic, coco, stearic, and ricinoleic, and oils such as castor oil and tall oil), fatty esters, fluorocarbon containing materials, glycerol esters (such as, for example, glycerol monostearate, glycerol monolaurate, glycerol dilaurate, glycerol monoricinoleate, and glycerol oleate), glycol esters (such as, for example, propylene glycol monostearate, ethylene glycol monostearate, ethylene glycol distearate, diethylene glycol monolaurate, diethylene glycol monolaurate, diethylene glycol monooleate, and diethylene glycol stearate), lanolin-based surfactants, monoglycerides, phosphate esters, polysaccharide ethers, propoxylated fatty acids, propoxylated alcohols, and propoxylated alkylphenols, protein-based organic surfactants, sorbitan-based surfactants (such as, for example, sorbitan oleate, sorbitan monolaurate, and sorbitan palmitate), sucrose esters and glucose esters, and thio- and mercapto-based surfactants.

In a preferred embodiment, one component of the present invention comprises one or more nonionic surfactants according to one or more of the structural formulas III and IV:

$$R^9—O—(CH_2——CH_2—O)_n—R^{10} \quad (III)$$

$$R^9—O—(CH_2—C(CH_3)H——O)_n—R^{10} \quad (IV)$$

wherein:

$R^9$ is a monovalent hydrocarbon group of from 1 to 30 carbons that may be linear, cyclic, branched, unsaturated, aromatic or fluoro containing; $R^{10}$ is hydrogen or a monovalent hydrocarbon group of 1 to 30 carbons that may be linear, cyclic, branched, unsaturated, aromatic or fluoro containing; and n is from about 1 to about 100, more preferably from about 1 to about 40. In a highly preferred embodiment, $R^9$ contains from 2 to about 24 carbons, even more preferably from 8 to 24 carbons, $R^{10}$ is H and n is from about 2 to about 20.

Other suitable nonionic surfactants include Polyethylene oxide condensates of nonyl phenol and myristyl alcohol, such as in U.S. Pat. No. 4,685,930 Kasprzak; and b) fatty alcohol ethoxylates, $R—(OCH_2CH_2)_aOH$ wherein a=1 to 100, typically 1 to 30, R=hydrocarbon residue 8 to 20 C atoms, typically linear alkyl. Examples polyoxyethylene lauryl ether, with 4 or 10 oxyethylene groups; polyoxyethylene cetyl ether with 2, 6 or 10 oxyethylene groups; polyoxyethylene stearyl ether, with 2, 5, 15, 20, 25 or 100 oxyethylene groups; polyoxyethylene (2), (10) oleyl ether, with 2 or 10 oxyethylene groups. Commercially available examples include, but are not limited to: BRIJ and NEODOL. See also U.S. Pat. No. 6,013,683 Hill et al. Other suitable nonionic surfactants include Tween™.

Suitable cationic surfactants include, but are not limited to dialkyldimethyl ammonium salts having the formula:

$$R'R''N^+(CH_3)_2X^-$$

wherein R' and R" are each independently selected from the group consisting of hydrocarbon containing moiety containing 1-30 C atoms or derived from tallow, coconut oil or soy, X=Cl, I or Br. Examples include: didodecyldimethyl ammonium bromide (DDAB), dihexadecyidimethyl ammonium chloride, dihexadecyidimethyl ammonium bromide, dioctadecyldimethyl ammonium chloride, dieicosyldimethyl ammonium chloride, didocosyldimethyl ammonium chloride, dicoconutdimethyl ammonium chloride, ditallowdimethyl ammonium bromide (DTAB). Commercially available examples include, but are not limited to: ADOGEN, ARQUAD, TOMAH, VARIQUAT. See also U.S. Pat. No. 6,013,683 Hill et al.

Also suitable surfactants are silicone surfactants including, but not limited to the polyalkyleneoxide polydimethylsiloxanes having a polydimethylsiloxane hydrophobic moiety and one or more hydrophilic polyalkyleneoxide side chains and have the general formula:

$$R'—(CH_3)_2SiO—[(CH_3)_2SiO]_a\text{-}[(CH_3)(R^1)SiO]_b—Si(CH_3)_2—R^1$$

wherein a+b are from about 1 to about 50, preferably from about 3 to about 30, more preferably from about 10 to about 25, and each R' is the same or different and is selected from the group consisting of methyl and a poly(ethyleneoxide/propyleneoxide) copolymer group having the general formula:

$$—(CH_2)_nO(C_2H_4O)_c(C_3H_6O)_dR^2$$

with at least one $R^1$ being a poly(ethyleneoxide/propyleneoxide) copolymer group, and wherein n is 3 or 4, preferably 3; total c (for all polyalkyleneoxide side groups) has a value of from 0 to about 100, preferably from about 6 to about 100; total d is from 0 to about 14, preferably from 0 to about 3; and more preferably d is 0; total c+d has a value of from about 5 to about 150, preferably from about 9 to about 100 and each $R^2$ is the same or different and is selected from the group consisting of hydrogen, an alkyl having 1 to 4 carbon atoms, and an acetyl group, preferably hydrogen and methyl group. Examples of these surfactants may be found in U.S. Pat. No. 5,705,562 and U.S. Pat. No. 5,707,613, both of which are incorporated herein by reference.

Examples of this type of surfactants are the Silwet™ surfactants which are available from CK Witco, OSi Division, Danbury, Connecticut. Representative Silwet™ surfactants are for example L-7608, L-7607, L-77, L-7605, L-7604, L-7600, L-7657, L-7602. The molecular weight of the polyalkyleneoxide group ($R^1$) is less than or equal to about 10,000. Preferably, the molecular weight of the polyalkyleneoxide group is less than or equal to about 8,000, and most preferably ranges from about 300 to about 5,000. Thus, the values of c and d can be those numbers which provide molecular weights within these ranges. However, the number of ethyleneoxide units ($—C_2H_4O$) in the polyether chain ($R^1$) must be sufficient to render the polyalkyleneoxide polysiloxane water dispersible or water soluble. If propyleneoxide groups are present in the polyalkyleneoxide chain, they can be distributed randomly in the chain or exist as blocks. Especially preferred Silwet™ surfactants are L-7600, L-7602, L-7604, L-7605, L-7657, and mixtures thereof. Besides cleaning and/or emulsifying activity, polyalkyleneoxide polydimethylsiloxane surfactants can also provide other benefits, such as anti-static benefits, and softness to fabrics.

The preparation of polyalkyleneoxide polydimetylsiloxanes is well known in the art. Polyalkyleneoxide polydimethylsiloxanes of the present invention can be prepared according to the procedure set forth in U.S. Pat. No. 3,299,112, incorporated herein by reference.

Another suitable silicone surfactant is SF-1488, which is available from GE silicone fluids. Especially preferred silicone surfactants include Tegopren™ 7008 and 7009 (ex Goldschmidt).

These and other surfactants suitable for use in combination with the organic dry cleaning solvent as adjuncts are well known in the art, being described in more detail in Kirk Othmer's Encyclopaedia of Chemical Technology, 3rd Ed., Vol. 22, pp. 360-379, "Surfactants and Detersive Systems", incorporated by reference herein. Further suitable nonionic detergent surfactants are generally disclosed in U.S. Pat. No. 3,929,678, Laughlin et al., issued Dec. 30, 1975, at column 13, line 14 through column 16, line 6, incorporated herein by reference. Other suitable detergent surfactants are generally disclosed in WO-A-0246517.

The surfactant or mixture of surfactants is present in a cleaning effective amount. A cleaning effective amount is the amount needed for the desired cleaning. This will, for example, depend on the number of articles, level of soiling and volume of dry cleaning composition used. However, surprisingly effective cleaning was observed when the surfactant was present from at least 0.001 wt. % to 10 wt. % by weight of the dry cleaning composition. More preferably, the surfactant is present from 0.01 to 3 wt. % or even more preferably from 0.05 to 0.9 wt. % by weight of the dry cleaning composition. More preferably, the surfactant is present from 0.1 to 0.8 wt. % or even more preferably from 0.3 to 0.7 wt. % by weight of the dry cleaning composition.

Optional Cleaning Agents

The dry cleaning compositions may contain one or more optional cleaning agents. Cleaning agents include any agent suitable for enhancing the cleaning, appearance, condition and/or garment care. Generally, the cleaning agent may be present in the compositions of the invention in an amount of about 0 to 20 wt. %, preferably 0.001 wt. % to 10 wt. %, more preferably 0.01 wt. % to 2 wt. % by weight of the total dry cleaning composition.

Some suitable cleaning agents include, but are not limited to, builders, enzymes, bleach activators, bleach catalysts, bleach boosters, bleaches, alkalinity sources, antibacterial agents, colorants, perfumes, pro-perfumes, finishing aids, lime soap dispersants, composition malodour control agents, odour neutralisers, polymeric dye transfer inhibiting agents, crystal growth inhibitors, photobleaches, heavy metal ion sequestrants, anti-tarnishing agents, anti-microbial agents, anti-oxidants, anti-redeposition agents, soil release polymers, electrolytes, pH modifiers, thickeners, abrasives, divalent or trivalent ions, metal ion salts, enzyme stabilisers, corrosion inhibitors, diamines or polyamines and/or their alkoxylates, suds stabilising polymers, process aids, fabric softening agents, optical brighteners, hydrotropes, suds or foam suppressors, suds or foam boosters, fabric softeners, anti-static agents, dye fixatives, dye abrasion inhibitors, anti-crocking agents, wrinkle reduction agents, wrinkle resistance agents, soil repellency agents, sunscreen agents, anti-fade agents, and mixtures thereof.

Using the compositions and processes noted above, a waste product is generated from the dry cleaning process.

The invention is specifically directed to novel method of ensuring the waste product is collected in a detachable/removable, disposable container. By disposable is meant that the container can be readily discarded by home user and discarded directly by user into garbage. This thus eliminates the need for a service person to come in and take, waste away or alternatively of having to flush the waste down.

As noted, it is preferred that initially insoluble waste be removed (e.g., by a filter in the machine drum or outside the drum prior to separation of insoluble waste from solvent); and subsequently insoluble waste should be removed (e.g., by distillation or evaporation of solvent to separate from waste).

In one embodiment, user may be notified that waste container needs to be changed. This may be done for example, by an indicator light which may be prompted by level of waste or weight of waste or simply by number of wash cycles.

Except in the operating and comparative examples, or where otherwise explicitly indicated, all numbers in this description indicating amounts or ratios of materials or conditions or reaction, physical properties of materials and/or use are to be understood as modified by the word "about".

Where used in the specification, the term "comprising" is intended to include the presence of stated features, integers, steps, components, but not to preclude the presence or addition of one or more features, integers, steps, components or groups thereof.

The following examples are intended to further illustrate the invention and are not intended to limit the invention in any way.

Unless indicated otherwise, all percentages are intended to be percentages by weight. Further, all ranges are to be understood to encompass both the ends of the ranges plus all numbers subsumed within the ranges.

EXAMPLES

Example 1

An indicator light goes off on the in-home dry cleaning machine indicating that it is time to replace the waste receiver. The consumer removes the readily detachable, full waste cartridge and disposes of it in their waste receptacle. The consumer then replaces the cartridge with a new, empty one that was purchased at a retail outlet.

The invention claimed is:

1. A method of disposing waste from an in-home dry cleaning machine which uses a dry cleaning solvent consisting of:

storing clean dry cleaning solvent in a clean solvent tank;

moving clean dry cleaning solvent via a first pump from the clean solvent tank into a machine drum to contact laundry articles to be cleaned;

separating the dry cleaning solvent from the laundry articles and recirculating the dry cleaning solvent to the machine drum to recontact the laundry articles by directing the dry cleaning solvent through a multi-way valve, a single second pump and a filter for removing insoluble waste during a first portion of a wash cycle;

separating the dry cleaning solvent from the laundry articles and moving the dry cleaning solvent through the multi-way valve to a used solvent tank following the first portion of the wash cycle;

moving the separated solvent from the used solvent tank via a third pump to a purification apparatus to separate waste material which is soluble in the solvent from the dry cleaning solvent by one of distillation and evaporation to clean the dry cleaning solvent;

collecting the dry cleaning solvent in the clean solvent tank;

moving the separated soluble waste via a gravity fed conduit to and collecting the separated soluble waste in a detachable, removable, disposable container, which may be removed and discarded or otherwise disposed of by a home user; and notifying the home user that the removable container is full and needs to be removed.

2. The method according to claim 1, wherein the solvent comprises a silicon component.

3. The method according to claim 2, wherein the solvent comprises a linear siloxane solvent.

4. The method according to claim 1, wherein the dry cleaning solvent is separated from the laundry articles by means of a spinning of the machine drum.

5. A method of disposing waste from an in-home dry cleaning machine which uses a dry cleaning solvent consisting of:

storing clean dry cleaning solvent comprising a silicon component in a clean solvent tank;

moving clean dry cleaning solvent via a first pump from the clean solvent tank into a machine drum to contact laundry articles to be cleaned;

separating the dry cleaning solvent from the laundry articles by spinning the machine drum and recirculating the dry cleaning solvent to the machine drum to recontact the laundry articles by directing the dry cleaning solvent through a multi-way valve, a single second pump and a filter for removing insoluble waste during a first portion of a wash cycle;

separating the dry cleaning solvent from the laundry articles by spinning the machine drum and moving the dry cleaning solvent through the multi-way valve to a used solvent tank following the first portion of the wash cycle;

moving the separated solvent from the used solvent tank via a third pump to a purification apparatus to separate waste material which is soluble in the solvent from the dry cleaning solvent by one of distillation and evaporation to clean the dry cleaning solvent;

collecting the dry cleaning solvent in the clean solvent tank;

moving the separated soluble waste via a gravity fed conduit to and collecting the separated soluble waste in a detachable, removable, disposable container, which may be removed and discarded or otherwise disposed of by a home user; and notifying the home user that the removable container is full and needs to be removed.

6. The method according to claim 5, wherein the solvent comprises a linear siloxane solvent.

7. A method of disposing waste from an in-home dry cleaning machine which uses a dry cleaning solvent consisting of:

storing clean dry cleaning solvent in a clean solvent tank;

moving clean dry cleaning solvent from the clean solvent tank into a machine drum to contact laundry articles to be cleaned via a first pump located between the clean solvent tank and the machine drum;

separating the dry cleaning solvent from the laundry articles and recirculating the dry cleaning solvent to the machine drum to recontact the laundry articles by directing the dry cleaning solvent through a single multi-way valve, a single second pump and a filter for removing insoluble waste during a first portion of a wash cycle;

separating the dry cleaning solvent from the laundry articles and moving the dry cleaning solvent through the single multi-way valve to a used solvent tank following the first portion of the wash cycle;

moving the separated solvent from the used solvent tank to a purification apparatus to separate waste material which is soluble in the solvent from the dry cleaning solvent by one of distillation and evaporation to clean the dry cleaning solvent via a third pump located between the used solvent tank and the purification apparatus;

collecting the dry cleaning solvent in the clean solvent tank;

moving the separated soluble waste via a gravity fed conduit to and collecting the separated soluble waste in a detachable, removable, disposable container, which may be removed and discarded or otherwise disposed of by a home user; and notifying the home user that the removable container is full and needs to be removed.

8. The method according to claim 7, wherein the solvent comprises a silicon component.

9. The method according to claim 8, wherein the solvent comprises a linear siloxane solvent.

10. The method according to claim 7, wherein the dry cleaning solvent is separated from the laundry articles by means of a spinning of the machine drum.

* * * * *

UNITED STATES PATENT AND TRADEMARK OFFICE

CERTIFICATE OF CORRECTION

PATENT NO. : 7,462,203 B2
APPLICATION NO. : 10/745073
DATED : December 9, 2008
INVENTOR(S) : Goldoni et al.

It is certified that error appears in the above-identified patent and that said Letters Patent is hereby corrected as shown below:

On the title page,

Add the following inventors:

Joel A. Luckman; Brian W. May; Vicki Lyn Wyatt; Mark B. Kovich; Tremitchell Wright and Daniel C. Conrad.

Signed and Sealed this

Twenty-sixth Day of May, 2009

JOHN DOLL
*Acting Director of the United States Patent and Trademark Office*